US008277338B2

(12) United States Patent
Sato et al.

(10) Patent No.: US 8,277,338 B2
(45) Date of Patent: Oct. 2, 2012

(54) GOLF BALL AND METHOD FOR DESIGNING SAME

(75) Inventors: Katsunori Sato, Chichibu (JP); Takuma Nakagawa, Chichibu (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 0 days.

(21) Appl. No.: 13/304,468

(22) Filed: Nov. 25, 2011

(65) Prior Publication Data

US 2012/0072184 A1 Mar. 22, 2012

Related U.S. Application Data

(62) Division of application No. 12/389,888, filed on Feb. 20, 2009, now Pat. No. 8,083,614.

(51) Int. Cl.
*A63B 37/06* (2006.01)

(52) U.S. Cl. ..... 473/378

(58) Field of Classification Search ..... 473/378–385, 473/409

See application file for complete search history.

(56) References Cited

U.S. PATENT DOCUMENTS 5,143,377 A 9/1992 Oka et al.
6,796,912 B2 9/2004 Dalton et al.
6,958,020 B1 10/2005 Ogg et al.
7,083,534 B2 8/2006 Ogg et al.
7,090,593 B2 8/2006 Sullivan
7,163,472 B2 1/2007 Dalton et al.
7,250,011 B2 7/2007 Simonds et al.
2005/0239579 A1 10/2005 Sato et al.
2006/0068939 A1 3/2006 Sato et al.
2007/0042838 A1 2/2007 Veilleux et al.
2008/0220901 A1 9/2008 Sato et al.
2010/0093468 A1 4/2010 Sato

*Primary Examiner* — Raeann Gorden
(74) *Attorney, Agent, or Firm* — Sughrue Mion, PLLC

(57) ABSTRACT

A golf ball includes noncircular dimples having smooth bottom surfaces; a method for designing the golf ball is disclosed. A noncircular dimple $D_{NC}$ has a border line which is a boundary line on the surface, the boundary line formed by connecting segments at some connecting points. The segments include at least one type of line segments LS and smoothly curved segments CS. A bottom surface BS of the noncircular dimple $D_{NC}$ includes at least five facets formed of at least five curved reference lines RC, each connecting a reference point A and one of at least five border points B, and each being tangential, at the reference point A, to a reference plane RP inside a virtual sphere having the radius of the ball, the reference point A set on the reference plane RP, the border points B set respectively at positions on the boundary line excluding the connecting points.

3 Claims, 11 Drawing Sheets

GOLF BALL AND METHOD FOR DESIGNING SAME

CROSS-REFERENCE TO RELATED APPLICATIONS

This application is a divisional of U.S. application Ser. No. 12/389,888, filed Feb. 20, 2009, the entire content of which is incorporated herein by reference.

BACKGROUND OF THE INVENTION

The present invention relates to a golf ball and to a method for designing the golf ball. More specifically, the present invention relates to a golf ball including noncircular dimples, and to a method for designing the golf ball.

For the purpose of increasing the carry of a golf ball, the golf ball has been heretofore designed to include multiple recessed parts, or dimples, on the surface thereof, and to use these dimples to produce aerodynamic effects when the golf ball is flying after being hit by a golf club. A dimple is a recessed part of a golf ball having a spherical shape in general, and is shaped as if the part is formed by truncating the surface of the spherical shape. A single golf ball includes multiple dimples of one kind or multiple kinds, and the dimples are arranged in various patterns.

Among conventional dimples, the most frequently used one is a dimple having a circular border line, called a circular dimple. When only circular dimples are arranged on the surface of a golf ball, the surface would have regions unoccupied by any dimples. Accordingly, the unoccupied regions are occupied by dimples each having a noncircular border line, called noncircular dimples. It is commonly known that combining circular dimples and noncircular dimples increases the surface coverage of the golf ball with the parts in which dimples are formed, i.e., dimple coverage on the surface, to a maximum extent, and thereby contributes to the increase of the carry of the golf ball due to the aerodynamic effects. It is also known that aerodynamic effects on the dimples may vary depending on the shape of each recessed part, i.e., the shape of the bottom surface of each dimple, as well as the border shape of each dimple.

BACKGROUND ART DOCUMENT

Patent Document

Patent Document 1: U.S. Pat. No. 7,250,011.

SUMMARY OF THE INVENTION

Problems to be Solved by the Invention

Since a noncircular dimple has a complex border shape, it is difficult to design a noncircular dimple having a smooth surface shape (contour) that is the outermost surface of a golf ball. Patent Document 1 (U.S. Pat. No. 7,250,011) discloses a method for forming noncircular dimples having smooth bottom surfaces by sectioning each bottom surface into an increased number of facets. However, each noncircular dimple thus formed still has ridge-like or valley-like lines on the bottom surface thereof, and thus fails to have a sufficiently smooth bottom surface. As a result of having the ridge-like or valley-like lines, the air resistance of the golf ball having noncircular dimples may increase.

An aspect of the present invention focuses on the shape of the bottom surfaces of noncircular dimples. Specifically, an object of an aspect of the present invention is to reduce the air resistance of the contour of each noncircular dimple included in a golf ball and thereby improve the aerodynamic performance of the golf ball. Moreover, an object of an aspect of the present invention is to form each noncircular dimple to have a smooth contour and thereby obtain a golf ball with a contour which has a new appearance from an aesthetic viewpoint.

Hence, according to any of the aspects of the present invention, a golf ball with an increased carry and improved appearance can be designed. This enables optimization of the surface shape of a golf ball, and thus contributes to an improvement in golf game gear.

Means for Solving the Problems

An aspect of the present invention provides a golf ball including a plurality of circular dimples and a plurality of noncircular dimples in a surface thereof, the noncircular dimples being provided between the circular dimples. Here, the noncircular dimples each have a border line which is a boundary line on the surface, the boundary line formed by connecting a plurality of border segments, wherein each border segment is any one of a line segment and a smoothly curved segment, the noncircular dimple has a bottom surface formed by connecting at least five facets to each other, the facets formed on the basis of at least five curved reference lines, and each of the curved reference lines passes a reference point set inside a virtual sphere and any one of at least five border points provided respectively at positions on the boundary line excluding connecting points of the border segments, and is tangential to a reference plane at the reference point, wherein the virtual sphere has a diameter corresponding to an external diameter of the golf ball, and wherein the reference plane having the reference point.

Another aspect of the present invention provides a method for designing a golf ball including a plurality of circular dimples and a plurality of noncircular dimples in a surface. The method includes the steps of: arranging the circular dimples; arranging the noncircular dimples between the circular dimples; determining, on a virtual sphere having a diameter corresponding to an external diameter of the golf ball, a shape of a border line of each of the noncircular dimples on the surface, as a boundary line formed by connecting a plurality of border segments each being any one of a line segment and a smoothly curved segment; determining, for the noncircular dimples, a reference point and a reference plane including the reference point, inside the virtual sphere; setting at least five border points respectively at positions on the boundary line excluding connecting points of the border segments; forming at least five curved reference lines each tangential to the reference plane at the reference point and each passing the reference point and a corresponding one of the at least five border points; and generating at least five facets each surrounded by corresponding ones of the curved reference lines and the border segments, thereby to determine a shape of a bottom surface of the noncircular dimple with a shape of connecting the facets to each other.

Thus, according to an aspect of the present invention, a golf ball with a reduced air resistance of the contour of each noncircular dimple and improved aerodynamic performance can be obtained. Moreover, another aspect of the present invention also focuses on the contour of each noncircular dimple, and forms a smooth contour of each noncircular dimple to obtain a golf ball with a contour which is new from an aesthetic viewpoint.

DESCRIPTION OF THE PREFERRED EMBODIMENTS

1. Outline of the Embodiments

Figure 1:
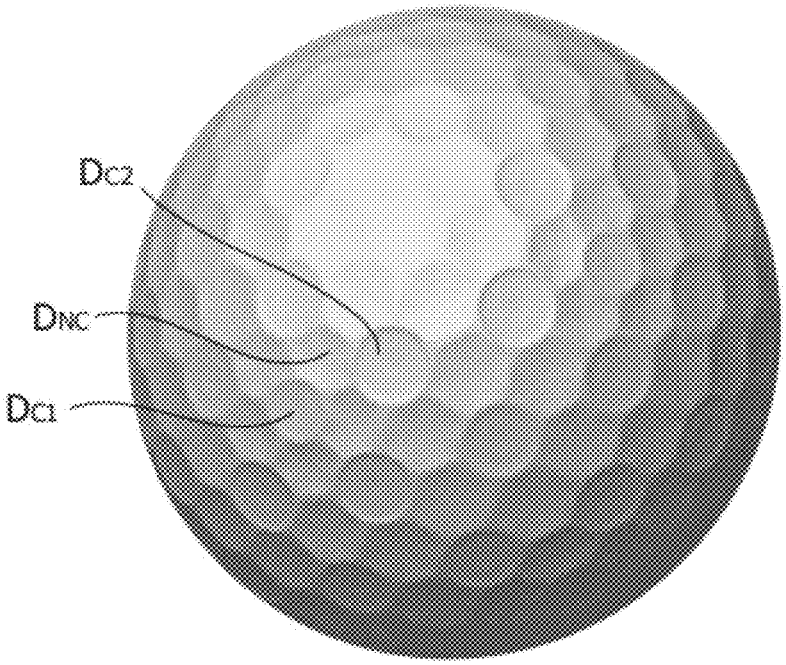
FIG. 1 is an external view of a comparative example of a golf ball manufactured on the basis of a design according to a comparative embodiment.

As to a golf ball having circular dimples, even though the circular dimples are positioned so as to be as numerous as possible on the surface of the golf ball, the surface still has regions, each of which has a surface area large enough to include a dimple, but is nevertheless not large enough to include a circular dimple. In some embodiments of the present invention, noncircular dimples are arranged in such regions. In the following, embodiments of the present invention will be described on the basis of the accompanying drawings. In the description, the same components will be denoted by the same reference numerals. To fully understand the embodiments of the present invention, a comparative embodiment will be described first. It is to be noted that the following description is to the same for the comparative embodiment and the embodiments, unless otherwise noted.

2. Shape of Golf Ball to be Designed

FIG. 1 shows an external appearance of a golf ball manufactured on the basis of a design according to the comparative embodiment. The golf ball shown in FIG. 1 includes a total of 272 dimples, i.e., a total of 92 circular dimples $D_{C1}$ and $D_{C2}$ and a total of 180 noncircular dimples $D_{NC}$, on its surface. Here, the dimple coverage on the surface is 88%. The noncircular dimples $D_{NC}$ collectively denote noncircular dimples with various shapes. A concrete procedure for designing such a golf ball by using a three-dimensional CAD will be described below.

2-1. Arrangement of Dimples

First, a virtual sphere having a diameter of the external diameter of the golf ball is defined. The virtual sphere defines, by its surface, parts (land parts), in which no dimples are to be formed, of the overall surface of the golf ball. Thereafter, regions in which circular-dimples are to be formed are arranged on the spherical surface of the virtual sphere. For this arrangement, any technique of arranging circular dimples as uniformly as possible can be used. In this example, the total number of the circular dimples is determined, and the two kinds of circular dimples $D_{C1}$ and $D_{C2}$ having different diameters are arranged. The diameters of the circular dimples shown in FIG. 1 are determined by taking into account that most parts of the remaining land parts are to be covered later by noncircular dimples.

Then, regions for the noncircular dimples $D_{NC}$ are arranged in the parts defined as the land parts. Each of the regions for the noncircular dimples is determined by firstly defining a region surrounded by the border lines of circular dimples and line segments, of which each line segment is connecting the border lines of two nearest circular dimples at the shortest distance, and then by shifting the border of the region inward by the amount of a width set for each land part between adjacent dimples. This will be fully described later. In this manner, the circular and noncircular dimples are arranged on the surface of the virtual sphere. Here, the line segments are each a line connecting the border lines of two circular dimples, and may be a line curving along the surface shape of the virtual sphere (part of the great circle of the virtual sphere) or a straight line merely connecting the border lines of adjacent circular dimples without curving along the surface shape of the virtual sphere.

2-2. Formation of Bottom Surface of Circular Dimple

The bottom surface of each of the circular dimples may be of any kind. Specifically, the bottom surface of the circular dimple may be of any kind, such as a part of the spherical surface, an ellipsoid of revolution, a paraboloid of revolution, or a double dimple.

2-3. Formation of Bottom Surface of Noncircular Dimple

Figure 2:
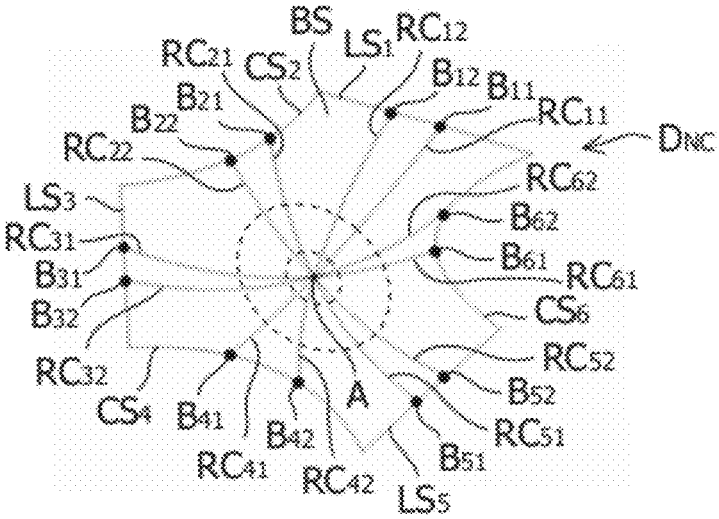
FIG. 2 is an enlarged perspective view of a noncircular dimple of the golf ball manufactured on the basis of the design according to the comparative embodiment.
Figure 3:
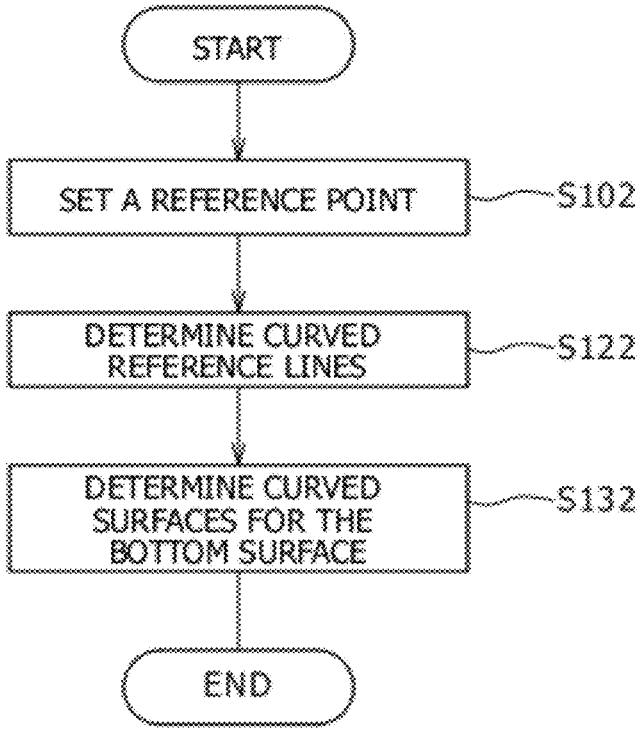
FIG. 3 is a flowchart for designing a bottom surface of the noncircular segment in the design according to the comparative embodiment.

FIG. 2 is an enlarged perspective view of a noncircular dimple, and FIG. 3 shows a flow of designing the bottom surface of the noncircular segment as shown in FIG. 2. The border line of the bottom surface of the noncircular dimple is formed of: line segments $LS_1$, $LS_3$ and $LS_5$ each connecting circular dimples; and curved segments $CS_2$, $CS_4$ and $CS_6$ each of which is an arc corresponding to a border part of a circular dimple. Hereinafter, the line segments and curved segments will collectively be called "border segments". The border line of the noncircular dimple includes connecting points of the border segments. Although the border segments are continuous at the connecting points, they are not always connected smoothly with one another, and the points may hence be vertices (corner points), for example. In the comparative embodiment, to design the bottom surface of the noncircular dimple having the border line formed by combining such border segments, first, a reference point (point A) is set (S102), next, curved reference lines using the reference point are determined (S122), and finally, the curved surface of the bottom surface is determined on the basis of the curved reference lines (S132).

2-3-1. Design of Bottom Surface according to Comparative Embodiment

Figure 4:
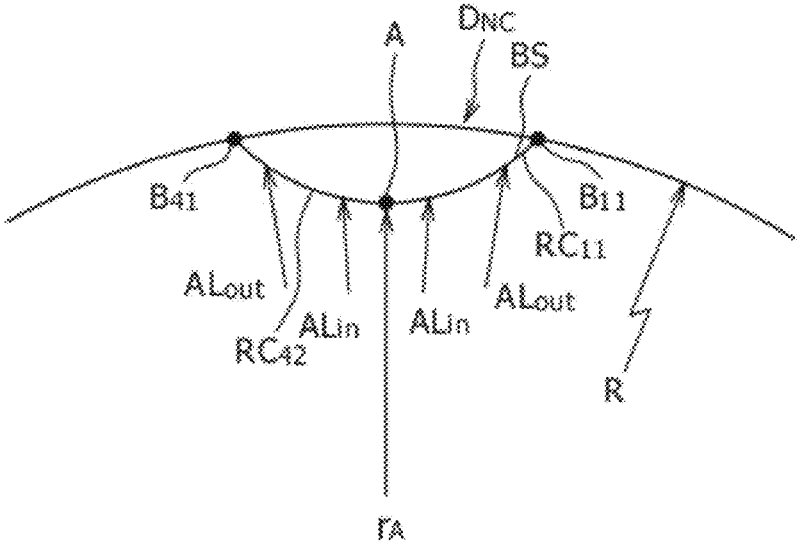
FIG. 4 is a cross-sectional view of a virtual sphere designed according to the comparative embodiment taken along a cross section passing a reference point of the noncircular dimple and the center of the virtual sphere in a radial direction.

Design of the bottom surface of the noncircular dimple according to the comparative embodiment will be described below. First, the reference point (point A) is set at a central part of the noncircular dimple region inside the virtual sphere (S102 in FIG. 3). This reference point is for defining an approximate depth of the noncircular dimple, and it is hence set closer to the center of the virtual sphere when designing a deep dimple, whereas it is set closer to the surface of the virtual sphere when designing a shallow dimple. FIG. 4 is a cross-sectional view of the virtual sphere taken along a cross section passing the reference point A of the noncircular dimple $D_{NC}$ and the center of the virtual sphere having a radius R.

Then, by using points on the border segments (border points) and the reference point A, curved reference lines $RC_{11}$ to $RC_{62}$ are determined (S122 in FIG. 3). Here, the curved reference lines $RC_{11}$ to $RC_{62}$ are to be used to determine facets which will form the curved surface of the bottom surface. Thus, a design technique according to the comparative embodiment employs a configuration having such a large number of curved reference lines that each facet would be minimized when forming the bottom surface of the noncircular dimple for making its shape as smooth as possible. For this purpose, in the design according to the comparative embodiment, two border points, for example, are set around the midpoint of each of the line segments and the curved segments forming the border part of the noncircular dimple. The border points are shown as border points $B_{11}$ to $B_{62}$ in FIG. 2. When the positions of the border points $B_{11}$ to $B_{62}$ are represented by relative positions that are indicated by the number of sections of equally divided into 100 sections for each of the border segments, the border points $B_{11}$ to $B_{62}$ are set at positions before and after a relative position 50 that is the midpoint, such as, at relative positions 40 and 60.

Figure 5:
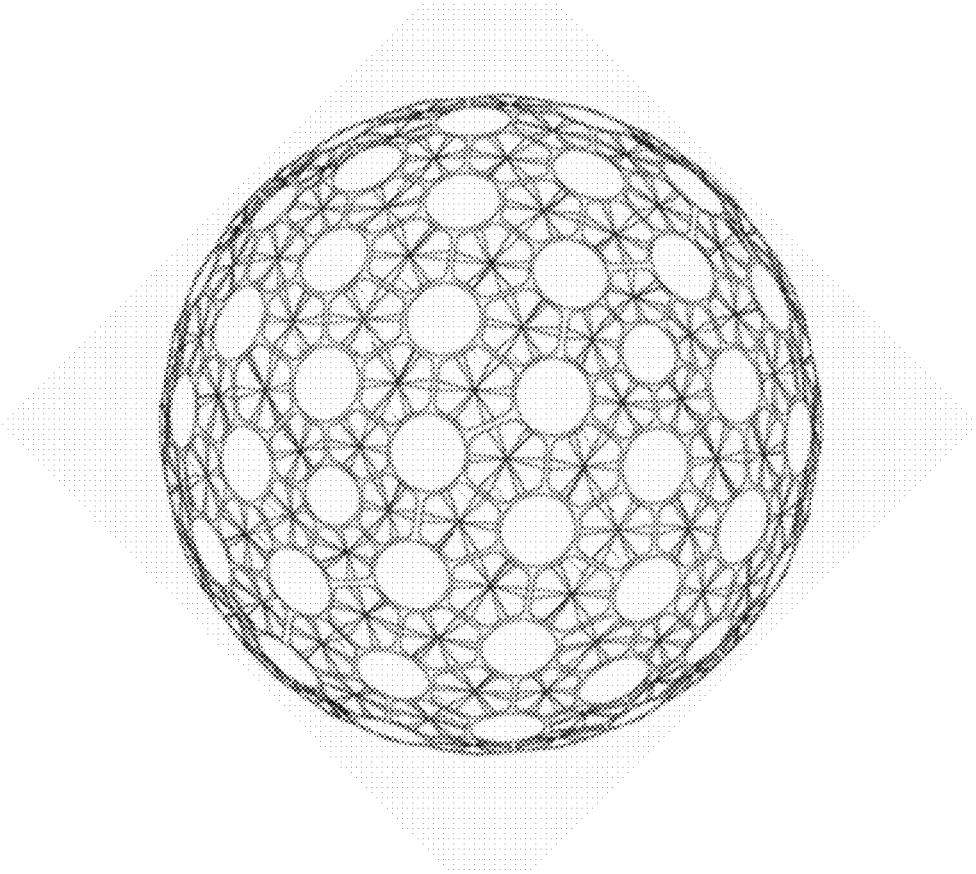
FIG. 5 is a schematic view showing the comparative example of the golf ball according to the comparative embodiment being designed and represented by design border segments and curved reference lines.

To determine curved reference lines, each pair of border points among the border points $B_{11}$ to $B_{62}$ and the reference point A are associated with one another to form a set of three points, wherein the border points of each pair are border points respectively on border segments approximately opposite to each other with respect to the reference point A, for example, the border point $B_{11}$ on the line segment $LS_1$ and the border point $B_{41}$ on the curved segment $CS_4$. The reference point A is included in each of all of the sets. Since the reference point A is set inside the virtual sphere, that is, in a position closer to the center of the virtual sphere than a position on the surface of the virtual sphere, the three points included in each set are not usually aligned on a single straight line. On the basis of the three points included in each set, curved reference lines are determined. First, a curved line connecting one border point on a border segment is determined, for example, the border point $B_{12}$, and the other border point on a border segment, for example, the border point $B_{42}$, while passing the reference point A. Then, the curved line is divided into two by the reference point, to determine curved reference lines. In FIG. 4, the connected curved reference lines $RC_{11}$ and $RC_{42}$ thus determined are shown. Similarly, the curved reference lines $RC_{11}$ to $RC_{62}$ are determined by using all the border points $B_{11}$ to $B_{62}$ and the reference point A shown in FIG. 2. FIG. 5 is a schematic view of the golf ball being designed and represented by the border segments and the curved reference lines used in this design.

Thereafter, by using the curved reference lines, the bottom surface having the border line formed of the border segments is determined (S132 in FIG. 3). In the example shown in FIG. 2, by using the 12 curved lines, i.e., the curved reference lines $RC_{11}$ to $RC_{62}$, the bottom surface having a border line formed of the line segments $LS_1$, $LS_3$ and $LS_5$ and the curved segments $CS_2$, $CS_4$ and $CS_6$ is determined. To determine the curved surface, parts of the curved surface to be components of the curved surface, that is, facets, are determined. A facet is defined by a region surrounded by border segments and curved reference lines. In the example in FIG. 2, facets are defined respectively by regions such as a region surrounded by three curved lines, the curved reference lines $RC_{11}$ and $RC_{12}$ and the line segment $LS_1$, and a region surrounded by four curved lines, the curved reference line $RC_{12}$, the line segment $LS_1$, the curved segment $CS_2$ and the curved reference line $RC_{21}$. Each facet is surrounded by at least one border segment and two curved reference lines. In other words, a facet is a smooth surface in a region having at least one border segment and two curved reference lines as its border line, and is usually a curved surface. The curved surfaces are each obtained on the basis of data on the border segment and the curved reference lines for the corresponding facet, by using any algorithm for defining a curved surface passing the border segment and the curved reference lines.

Figure 6:
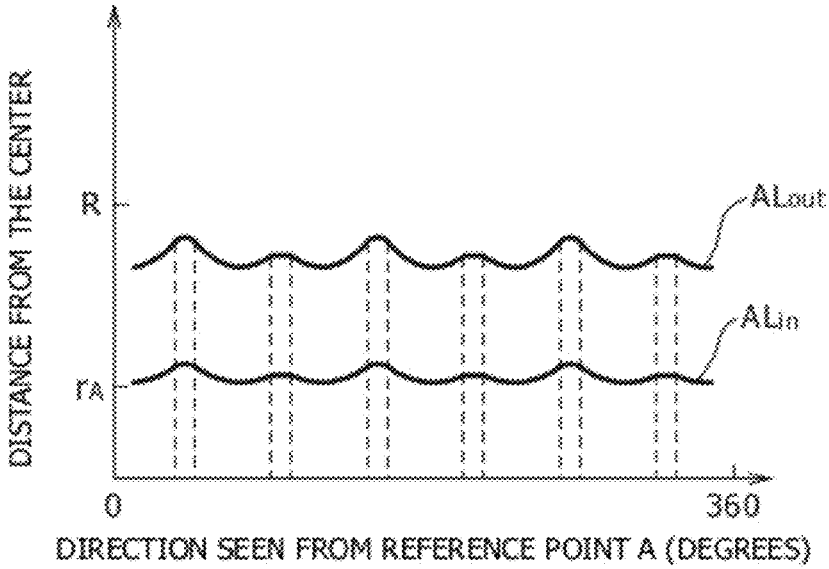
FIG. 6 is a graph showing profiles each plotting distances of the bottom surface of the noncircular dimple from the center of the virtual sphere in the design according to the comparative embodiment.
Figure 7:
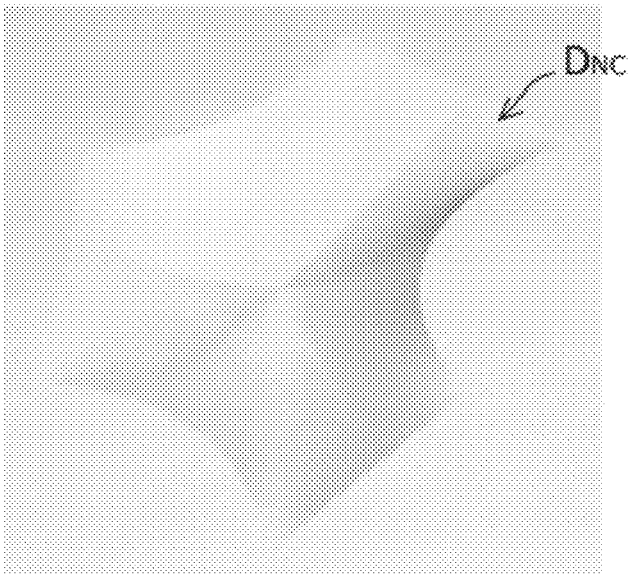
FIG. 7 is an enlarged view of a surface of the golf ball manufactured on the basis of the design according to the comparative embodiment.

When the curved surfaces that are to be the facets are determined, the facets are connected to form the bottom surface of the noncircular dimple. This bottom surface is shown as a bottom surface BS in FIGS. 2 and 4. The shape of the bottom surface BS in the comparative embodiment is not necessarily smooth at the connecting parts of the facets, or around the curved reference lines, even though the facets are continuous in the connecting parts. To illustrate the situation, FIG. 6 shows profiles plotting the "heights" of the bottom surface BS, that is, distances of the bottom surface BS from the center of the virtual sphere, around the reference point and around the border line. FIG. 6 shows distances (heights) of the bottom surface BS from the center of the virtual sphere at positions around the reference point A and positions around the border line schematically shown by chain lines in FIG. 2 and by arrows in FIG. 4. In FIG. 6, directions from the reference point A are shown in the horizontal axis, whereas the heights at the respective directions are shown in the vertical axis, and the heights around the reference point A and the heights around the border line are shown by curved lines $AL_{in}$ and $AL_{out}$, respectively. For comparison, a distance $r_A$ of the reference point A from the center of the virtual sphere, that is, the height of the reference point A, and the radius R of the virtual sphere are also shown. It is to be noted that, in FIG. 6, the profiles of the surface are exaggerated compared to the actual ones for the purpose of illustration. As shown in FIG. 6, with the design according to the comparative embodiment, although a large number of curved reference lines, that is, 12 curved reference lines, are used, the bottom surface of the noncircular dimple still has non-smooth regions. Specifically, the bottom surface includes ridge-like or valley-like lines radially extending from the reference point along the reference lines. This situation can also be observed in an enlarged view of the surface of the golf ball shown in FIG. 7.

In the above-described design, two border points are set respectively at the positions corresponding to the relative positions 40 and 60 on each border segment. If the border points are positioned near the connecting points of the border segments (corner points), the bottom surface of the noncircular dimple reflects the shapes around the corner points and consequently includes non-smooth ridge-like or valley like lines radially extending from the reference points along the reference lines.

Such ridge-like or valley-like lines often deteriorate the aerodynamic performance of the golf ball. The inventors of the present invention have been concerned that this deterioration may increase the total air resistance of the golf ball. In particular, the inventors have been concerned that the increase may become more prominent as the shapes of the noncircular dimples become more complex and, as a consequence, the ridge-like or valley-like lines increase. In addition, if the golf ball includes more ridge-like or valley-like lines, the lines become more conspicuous, and the golf ball tends to be poorer in design of its external appearance.

2-3-2. Design of Bottom Surface According to Preferred Embodiments of the Invention To avoid generating the bottom surface including the above-described ridge-like or valley-like lines, or non-smooth regions, a different technique from the above-described design technique is used to design the bottom surface in the embodiments of the present invention. Specifically, in a first embodiment, a reference plane including the reference point A is used. In a second embodiment of the present invention, in addition to the reference plane used in the first embodiment, a boundary condition for forcing the boundaries between facets, which are curved surfaces forming the bottom surface, to be smooth is imposed, in order to avoid generating the non-smooth regions.

2-3-2-1. First Embodiment

Figure 8:
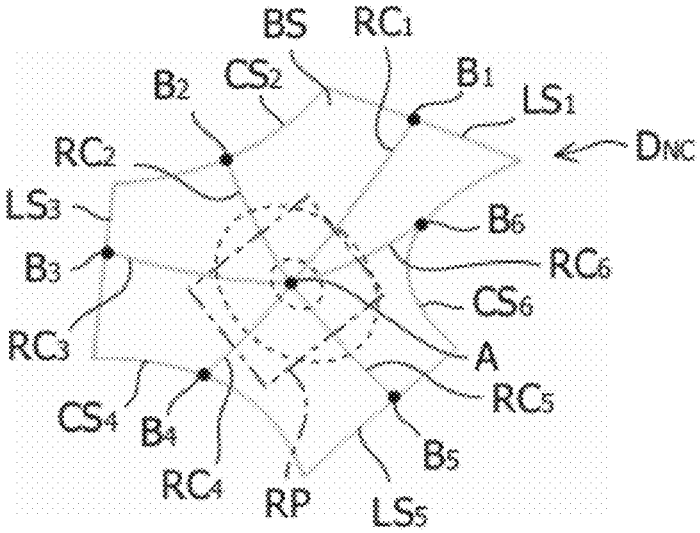
FIG. 8 is an enlarged perspective view of a noncircular dimple according to an embodiment of the present invention.
Figure 9:
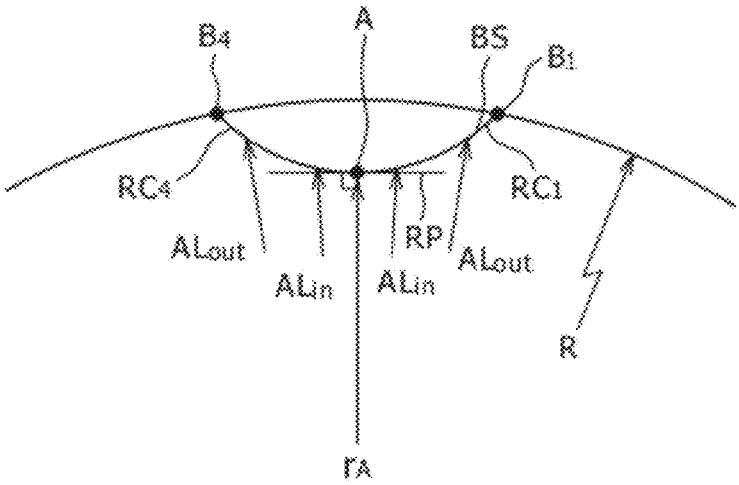
FIG. 9 is a cross-sectional view of a virtual sphere taken along a cross section passing a reference point of the noncircular dimple according to the embodiment of the present invention.
Figure 10:
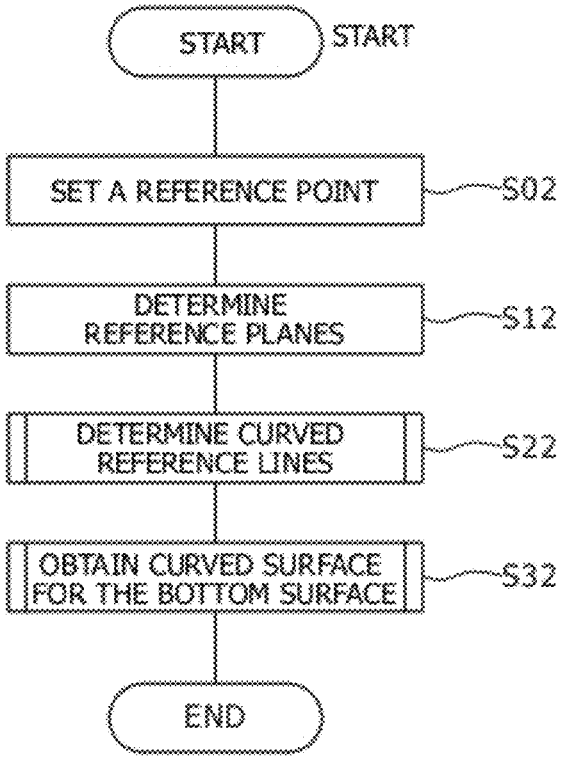
FIG. 10 is a flowchart for designing a noncircular dimple of a golf ball according to an embodiment of the present invention.
Figure 11:
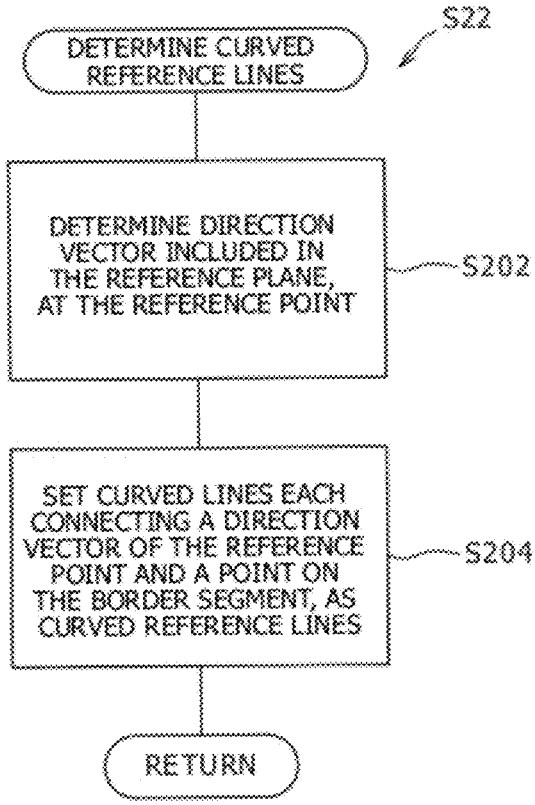
FIG. 11 is a flowchart for designing the noncircular dimple of the golf ball according to the embodiment of the present invention.
Figure 12:
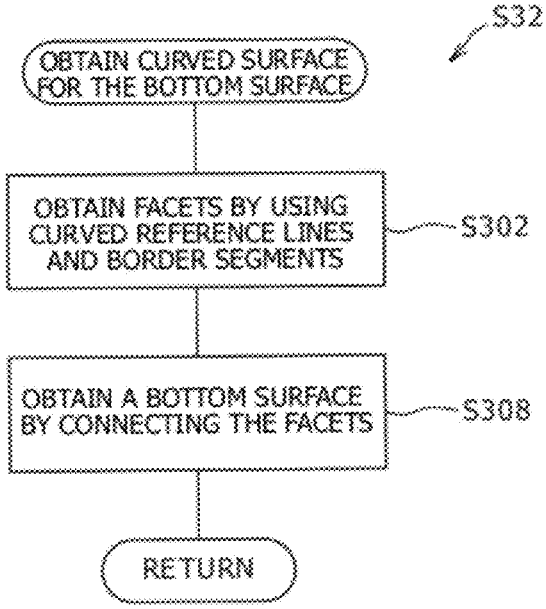
FIG. 12 is a flowchart for designing the noncircular dimple of the golf ball according to the embodiment of the present invention.

In relation to the first embodiment of the present invention, FIG. 8 shows an enlarged perspective view of a noncircular dimple, FIG. 9 shows a cross-sectional view of a virtual sphere taken along a cross section passing the reference point of the noncircular dimple, and FIGS. 10 to 12 show design flows of the noncircular dimple.

In this embodiment, determination of a reference plane is performed, in addition to the design technique used in the comparative embodiment. The determined reference plane is used to determine curved reference lines. Specifically, also in the first embodiment, first, the reference point is set around a central part of the noncircular dimple region (S02 in FIG. 10). The reference point is set inside the virtual sphere as in the comparative embodiment.

Then, a reference plane including the reference point A is determined (S12). This reference plane is shown as a reference plane RP in FIG. 9. The reference plane is used to determine curved reference lines, and is hence not formed in the actual golf ball. Preferably, the reference plane is determined to be perpendicular to a radial direction connecting the reference point and the center of the virtual sphere. However, the reference plane according to the present invention is not limited to that perpendicular to the radial direction. In FIG. 8, the reference plane RP is represented by alternate long and short dash lines.

Thereafter, the curved reference lines are determined (S22). In this determination in the first embodiment, unlike the determination of the curved reference lines in the comparative embodiment, the curved reference lines are each determined by using a border point set approximately at the midpoint of a corresponding border segment, the reference point and the reference plane. In FIG. 8, curved reference lines $RC_1$ to $RC_6$ are determined by using border points $B_1$ to $B_6$ set respectively around the midpoints of the border segments, the reference point A and the reference plane RP. Here, the positions of the border points on the border segments are not particularly limited to the midpoints, but are not to be around connecting parts of the border segments, that is, around corners of the border line. Specifically, assume that the position of each border point is represented by a corresponding one of relative positions 0 to 100 along the corresponding border segment. In this case, the border point is set at a relative position between approximately 30, preferably approximately 40, and 70, preferably 60, inclusive. Alternatively, the border points of each two border segments opposite to each other (for example, the point $B_1$ and the point $B_4$) may be set on a plane passing the center of the virtual sphere, together with the reference point A.

In FIG. 8, the curved reference lines $RC_1$ to $RC_6$ are shown. The curved reference lines in the first embodiment are each determined so as to pass the border point, set at the midpoint of the corresponding border segment, and the reference point, and to be tangential to the reference plane RP at the reference point A. Here, "a curved line is tangential to a plane at a point on a plane" means that the curved line passes the point and the direction vector of the curved line is included in the plane at the point, in other words, the curved line passes the point and the direction vector of the curved line is perpendicular to the normal vector of the plane at the point. Accordingly, the curved reference lines $RC_1$ to $RC_6$ each pass the reference point A and have a direction vector included in the reference plane RP at the reference point A. Moreover, the direction vector of each of the curved reference lines $RC_1$ to $RC_6$ at the reference point A is perpendicular to the normal vector of the reference plane RP. FIG. 9 illustrates a situation in which the curved reference lines $RC_1$ and $RC_4$ are tangential to the reference plane RP at the reference point A.

To obtain the curved reference lines thus tangential to the reference plane, first, the direction vector included in the reference plane is defined at the reference point A (S202), as shown in FIG. 11. This direction vector can be generated by mathematical calculation. For example, to generate such a direction vector by using the reference point A, the border point $B_1$ and the reference plane RP, a vector from the reference point A to the border point $B_1$ is obtained, the vector is projected on the reference plane RP, and the vector is normalized if necessary. Such generation can be performed by applying a Gram-Schmidt orthogonalization process to the normal vector of the reference plane RP and the vector from the reference point A to the border point $B_1$, and then calculating the normal vector of the reference plane RP and a vector orthogonal to the normal vector.

Figure 13:
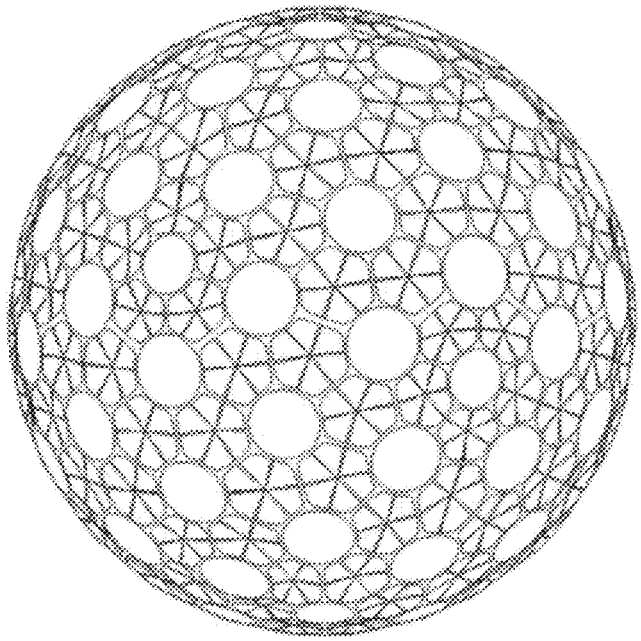
FIG. 13 is a schematic view showing an example of the golf ball being designed and represented by border segments of the noncircular dimples and curved reference lines according to the embodiment of the present invention.

Then, by using the direction vector thus generated, a curved line connecting the reference point A and the border point $B_1$ is generated as a curved reference line (S204). This curved reference line may be any of various curved lines tangential to the reference plane RP at the reference point A as described above. FIG. 13 shows a schematic view of the golf ball being designed and represented by the border segments and the curved reference lines used in the design according to the first embodiment.

Thereafter, on the basis of the curved reference lines, the bottom surface, which is a curved surface having the border segments as the border line, is determined (S32 in FIG. 10). In the first embodiment of the present invention, the same technique as that used in the comparative embodiment is used. Specifically, by using the line segments $LS_1$, $LS_3$ and $LS_5$, the curved segment $CS_2$, $CS_4$ and $CS_6$, and the curved reference lines $RC_1$ to $RC_6$, facets are determined (S302 in FIG. 12). In FIG. 8, the bottom surface of the noncircular dimple is formed of six facets. As in the technique used in the comparative embodiment, each facet is defined on the basis of data on the border segments and the curved reference lines for the facet, by using any algorithm for defining a curved surface. Thereby, the facets are connected, to form the curved surface of the bottom surface (S302 in FIG. 12). The bottom surface BS thus obtained is shown as a bottom surface BS in FIGS. 8 and 9. Here, although it is described above for the illustration of the configuration that the facets are connected to obtain the curved line of the bottom surface, adjacent facets obtained on the basis of the same curved reference line are naturally connected, and hence no particular process is required.

Figure 14:
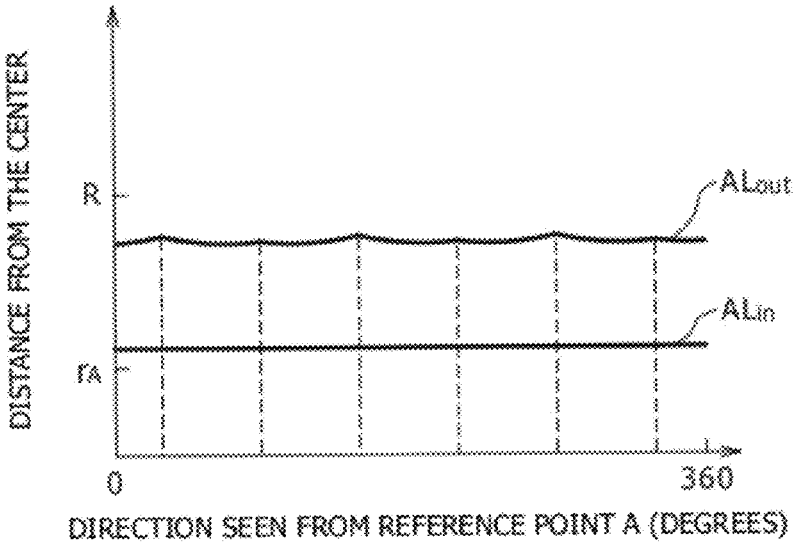
FIG. 14 is a graph showing profiles each plotting distances of the bottom surface of the noncircular dimple from the center of the virtual sphere according to the embodiment of the present invention.
Figure 15:
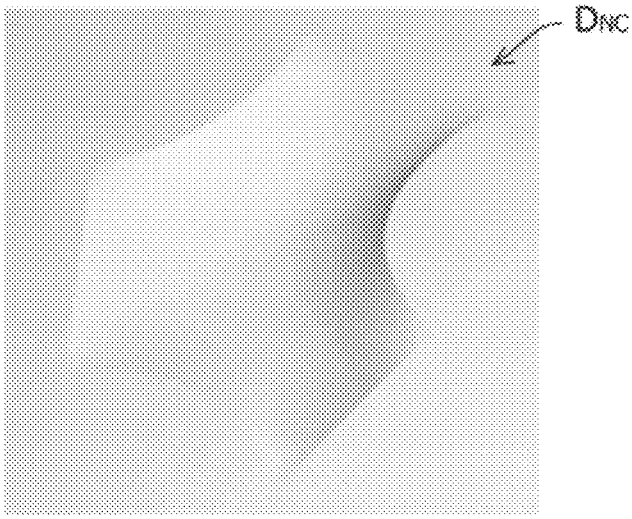
FIG. 15 is an enlarged view of a surface of the golf ball manufactured on the basis of the design according to the embodiment of the present invention.

The shape of the curved surface of the bottom surface thus obtained is shown in FIG. 14 in the form of height profiles and in FIG. 15 as an enlarged view of the surface. In FIG. 14, heights $AL_{in}$ around the reference line and heights $AL_{out}$ around the border line show a state in which the bottom surface, particularly around the reference point, is smooth by having uniform heights. Specifically, in the graph in FIG. 14, the heights $AL_{in}$ around the reference point are approximately the same irrespective of the directions, and are plotted by an approximately straight line in the graph. Furthermore, even at parts distant from the reference point, that is, at parts close to the border line, the connecting parts of the facets are smoother than those obtained in the comparative embodiment, although the number of curved reference lines is half as large as that used in the technique of the comparative embodiment. Specifically, in the graph in FIG. 14, the heights $AL_{out}$ around the border line are plotted by an only slightly broken line. This state is also observed in the enlarged view of the surface of the golf ball shown in FIG. 15. Here, the graph of the heights $AL_{in}$ around the reference point shows a straight line when the reference plane RP is perpendicular to a radius vector connecting the center of the virtual sphere and the reference point A. Moreover, in FIG. 14, as in FIG. 6, the profiles of the surface are exaggerated compared to the actual ones, for the purpose of illustration.

Thus, according to the first embodiment of the present invention, the bottom surface of the noncircular dimple can be designed to be a curved surface which is smoother than that in the comparative embodiment.

2-3-2-2. Second Embodiment

In the second embodiment, in addition to the reference plane used in the first embodiment, a boundary condition for forcing the boundaries between facets, which are curved surfaces forming the bottom surface of each noncircular dimple, to be smooth is imposed, in order to avoid generating non-smooth regions at the boundary parts of the facets. In this embodiment, curved reference lines are obtained in the same procedure as Steps S02, S12 and S22 in FIG. 10 and the steps in FIG. 11. However, in Step S32 in FIG. 10, to obtain the curved surface for the bottom surface, design is performed according to a design flow shown in FIG. 16.

Figure 17:
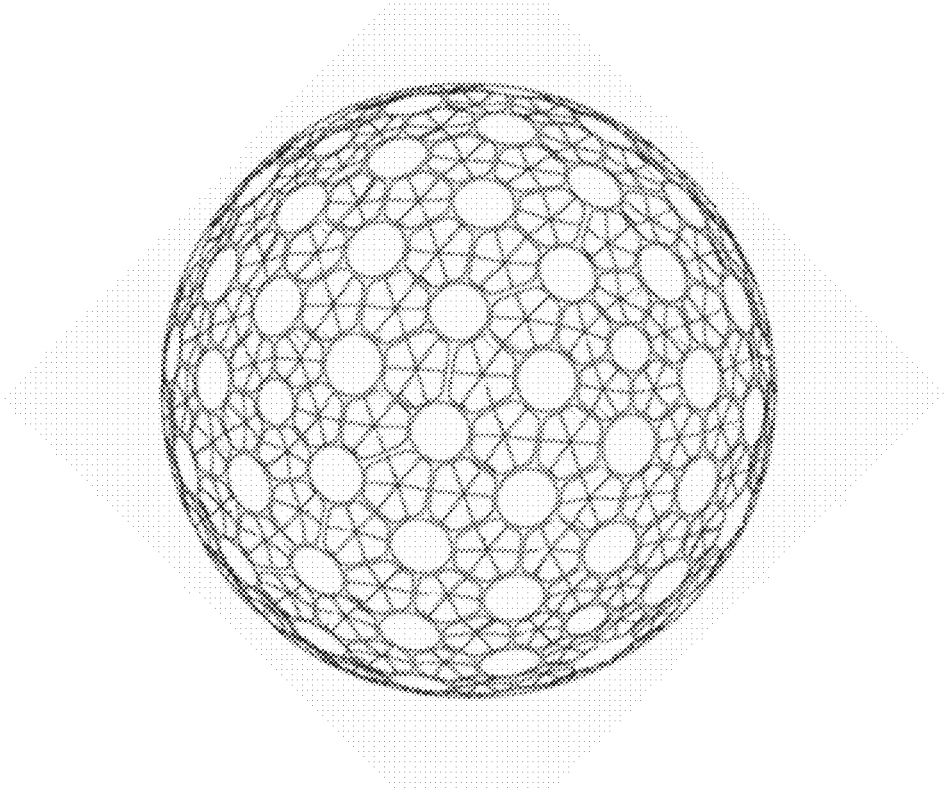
FIG. 17 is a schematic view of the golf ball being designed and represented by border segments of the noncircular dimples and curved reference lines according to the embodiment of the present invention.

Specifically, in the second embodiment, first, the curved reference lines determined by the same process as that in the first embodiment are used (Steps S02, S12 and S22 in FIG. 10 and the steps in FIG. 11). FIG. 17 shows a schematic view of the golf ball being designed and represented by the border segments and the curved reference lines used in the design according to the second embodiment.

Figure 16:
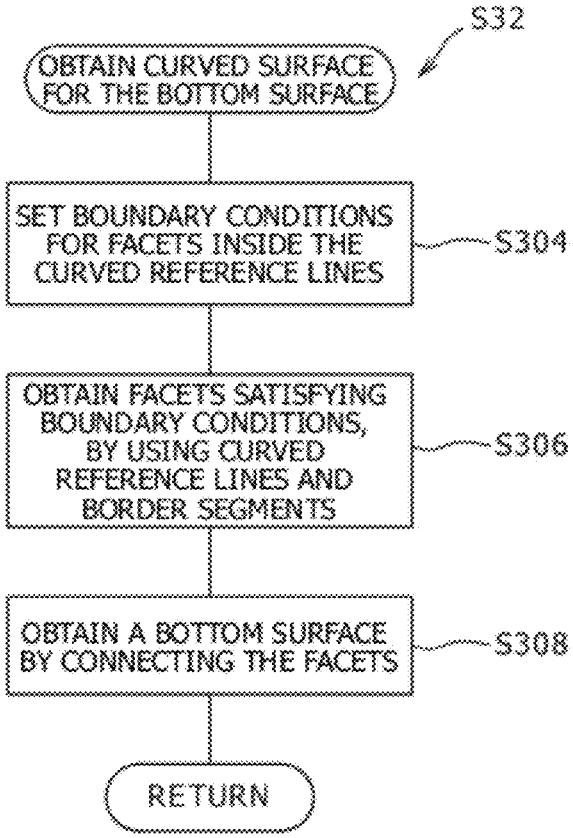
FIG. 16 is a flowchart for designing the noncircular dimple according to the embodiment of the present invention.

Then, in the second embodiment, a boundary condition is set for the facets on both sides of each of the curved reference lines (S304 in FIG. 16). The boundary condition is set in conjunction with the facets on both sides of each of the curved reference lines. Specifically, on two facets positioned respectively on both sides of a curved reference line, such a boundary condition that the two facets on the both sides would have the same tangential plane at any point on the curved reference line is imposed. To express this boundary condition mathematically, first, a vector equation of a curved surface is expressed as $$r=r(u,v)$$

where u and v are two independent parameters and r is a position vector on the curved surface of the facet and can be expressed as $r=(r_x, r_y, r_z)^T$. Here, $(\ )^T$ indicates transposition. Assume that a point $r_1$ on a first facet and a point $r_2$ on a second facet are expressed by such position vectors. In this case, the state in which the points on the both facets each corresponding to the parameter $(u_0, v_0)$ are "connected" means that the relationship $$r_1(u_0,v_0)=r_2(u_0,v_0)$$

holds. If the relationships $$\partial r_1/\partial u(u_0,v_0)=\partial r_2/\partial u(u_0,v_0)$$

and $$\partial r_1/\partial v(u_0,v_0)=\partial r_2/\partial v(u_0,v_0)$$

hold, in addition to the above relationship, at the connecting point $r_1(u_0, v_0)=r_2(u_0, v_0)$, the facets are connected "smoothly." In other words, the situation in which two facets on both sides of a curved reference line are "smoothly connected" means that the above two sets of relationships hold at any point on the curved reference line.

In terms of geometry, the first facet is generated on one side of a curved reference line while the second facet is generated on the other side of the same curved reference line. In this case, at each point of each of the first and second facet, a tangential plane having the point as a point of contact is defined. If the two facets on both sides have the same tangential plane at any point on the curved reference line, the facets are "smoothly connected" at the curved reference line. In other words, the facets are smoothly connected at the curved reference line under the condition that, when the points of contact of the respective tangential planes move from the inner sides of the respective facets toward a point on the curved reference line, the tangential plane of the first facet and the tangential plane of the second facet become the same at some point. Here, the tangential plane on the first facet is a surface defined by two vectors $\partial r_1/\partial u(u, v)$ and $\partial r_1/\partial v(u, v)$, and the tangential plane on the second facet is a surface defined by two vectors $\partial r_2/\partial u(u, v)$ and $\partial r_2/\partial v(u, v)$. Accordingly, if the facets are smoothly connected at the point $r_1(u_0, v_0)=r_2(u_0, v_0)$, the above equation can be obtained when $(u, v)=(u_0, v_0)$. Any means can be used for a process to make such geometric tangential planes the same in three-dimensional CAD.

Thereafter, by using the curved reference lines and the border segments, facets satisfying the boundary condition are obtained (S306), and the facets are connected to form the curved line of the bottom surface (S308). As in the first embodiment, no particular process is necessary to connect the facets to obtain the curved line of the bottom surface in the actual design.

Figure 18:
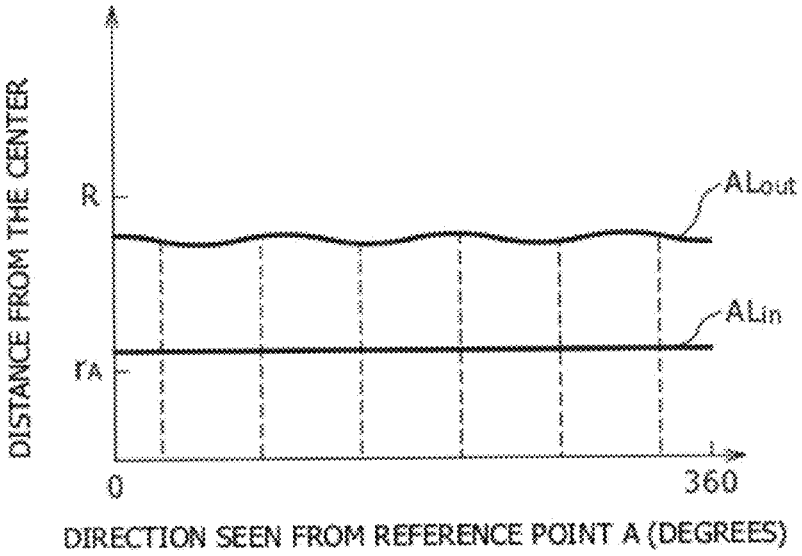
FIG. 18 is a graph showing profiles each plotting distances of the bottom surface of the noncircular dimple from the center of the virtual sphere according to the embodiment of the present invention.
Figure 19:
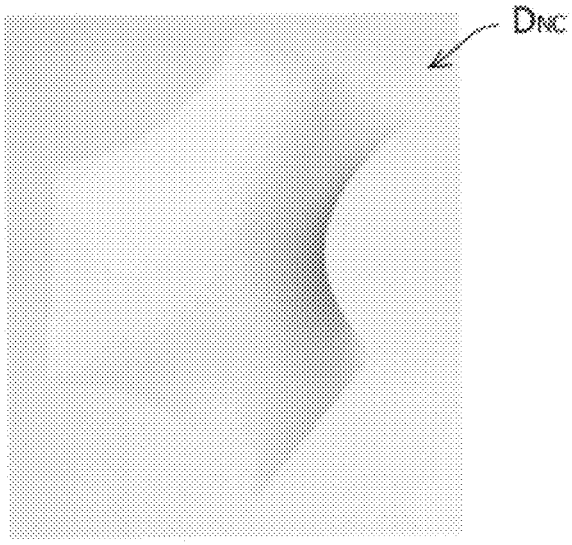
FIG. 19 is an enlarged view of a surface of the golf ball manufactured on the basis of the design according to the embodiment of the present invention.

The shape of the curved surface of the bottom surface thus obtained is shown in FIG. 18 in the form of graph showing height profiles and in FIG. 19 as an enlarged view of the surface. In FIG. 18, as in FIG. 14, heights $AL_{in}$ around the reference point A and heights $AL_{out}$ around the border line are substantially straight lines, illustrating a situation in which the bottom surface of the noncircular dimple is smooth with uniform heights. Specifically, in FIG. 18, the graph of the heights $AL_{in}$ around the reference point A is a substantially straight line, and the graph of the heights $AL_{out}$ around the border line is, although being a curved line, smooth at every part. This bottom surface profile is also observed in the enlarged view of the surface of the golf ball shown in FIG. 19. Here, in FIG. 18, as in FIGS. 6 and 14, the profiles of the surface are exaggerated compared to the actual ones, for the purpose of illustration.

Thus, according to the second embodiment of the present invention, the bottom surface of the noncircular dimple can be designed as a more smoothly curved surface than that designed in the first embodiment. This may suppress an increase in the total air resistance of the golf ball. In particular, since the number of ridge-like or valley-like lines does not increase even when the noncircular dimples have complex shapes, the shape of the noncircular dimple can be designed more freely. Furthermore, since the number of ridge-like or valley-like lines does not increase, the design of the external appearance of the golf ball can be improved.

3. Implementation by Computer

Next, an implementation example in which the above-described designs are implemented by a computer will be described.

3-1. Outline of Implementation by Computer

In a shape design for designing a golf ball by using three-dimensional CAD software that runs on a computer, first, a virtual sphere is defined. Since the virtual sphere is defined by specifying the radius R and thereby defining the spherical surface, at least the radius R or information sufficient to define the radius R is stored in any memory unit.

Then, dimples are arranged on the virtual sphere. Here, circular dimples and noncircular dimples are arranged as the dimples, as described above. The circular dimples can each be arranged by setting the center position on the surface of the virtual sphere. For example, by using polar coordinates having the center of the virtual sphere as the origin, the center position of the circular dimple is defined by a polar angle $\theta$ and an azimuth angle $\phi$. To arrange the circular dimples evenly on the spherical surface of the virtual sphere, arrangement of faces and arrangement of vertices of a regular polyhedron, such as a regular icosahedron, a regular dodecahedron or a regular octahedron, or a spherical polyhedron derived from such a regular polyhedron can be used. For example, by further dividing each face of a regular icosahedron into triangles, contours of the spherical surface can be expressed. Moreover, by adjusting the number of the triangles, the number of circular dimples can also be adjusted freely. The total number of the dimples, including the number of the noncircular dimples to be described later, is preferably between approximately 200 and approximately 500 inclusive. Thereafter, the sizes of the circular dimples are determined by using any information that can identify the position of the border line of each circular dimple, for example, the diameter or the radius of the circular dimple. The size of each circular dimple can be determined on the basis of the number of circular dimples arranged around the dimple. For example, the size of a circular dimple $D_{C1}$ with 5 circular dimples arranged therearound can be set smaller than that of a circular dimple $D_{C2}$ (see FIG. 20). The numbers and sizes of the circular dimples can be designed by taking account of aerodynamic effects and aesthetic appearance. Thus, the position and the size of each circular dimple are stored.

3-2. Design of Noncircular Dimples

The outline of the design of each noncircular dimple is as described above. To design such a noncircular dimple by using a computer, the border line, the reference point, the reference plane, the curved reference lines, and the facets may be set in this order. The details will be described below.

3-2-1. Setting of Border Lines

Each border line can be defined based on a region surrounded by arcs of the border lines of the already-set circular dimples and line segments each connecting the border lines of the arranged circular dimples with one another at the shortest distance, by shifting the border of the region inward by the amount of a width set for each of the land parts between adjacent dimples. Here, each of the line segments connecting the border lines of two closest circular dimples at the shortest distance is considered to be part of the great circle of the virtual sphere passing the centers of the two circular dimples.

Figure 20:
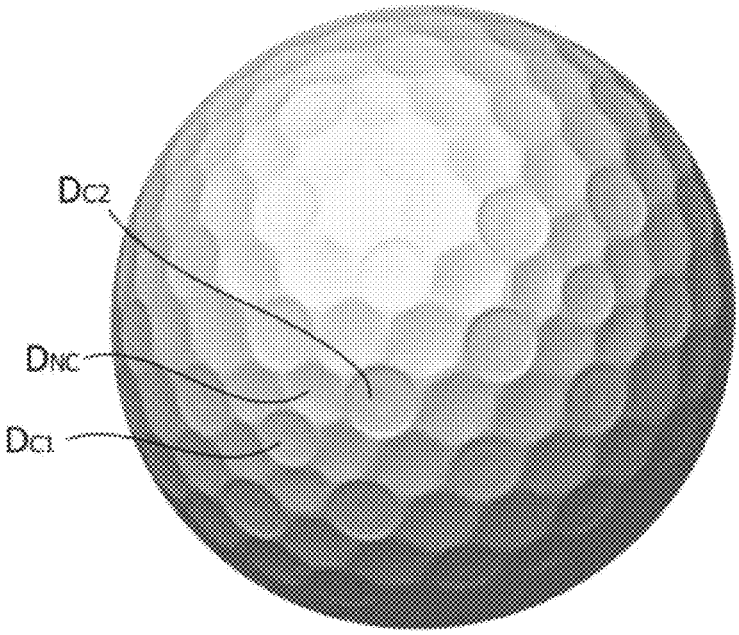
FIG. 20 is an external view of an example of a golf ball manufactured on the basis of a design according to an embodiment of the present invention.

Such a line segment can be obtained by calculating a vector which are perpendicular to two vectors from the center of the virtual sphere to the centers of these circular dimples, obtaining a plane passing the center of the virtual sphere by using the obtained vector as a normal vector of the plane, and then obtaining a curved line that is a crossing line of the virtual sphere and the obtained plane. By using plate-shaped regions having a thickness corresponding to the values set for the widths of the land parts, line segments as the border segments can be determined in consideration of the widths of the land parts. Such a line segment is determined for each pair of the circular dimples. In contrast, the curved segment can be determined based on an arc of the border line of the circular dimple by drawing an arc on the virtual sphere, the arc forming a part of a circle which is concentric with the circumference of the border line of the circular dimple adjacent to the noncircular dimple, and which has a radius obtained by adding the value of the width of the land part to the radius of the adjacent circular dimple. In this manner, border segments are determined for each of the noncircular dimples, and information defining each of the border segments (border segment definition information) is stored. In the configuration shown in FIG. 20, 6 facets are used for each noncircular dimple. However, 5, instead of 6, border segments may be used for a noncircular dimple, providing the noncircular dimple with 5 border points, or border points may be set on 5 out of 6 border segments, depending on design. In addition, in the case in which circular dimples and noncircular dimples are used as shown in FIG. 20, when the positions and the sizes of the circular dimples surrounding each noncircular dimple are determined, the shape of the border line of the noncircular dimple is automatically obtained by adding the values of the widths of the land parts. At this stage, the arrangement of the circular dimples and the widths of the land parts are adjusted to thereby adjust the coverage of the dimple area on the entire area of the golf ball surface (surface coverage) freely. This surface coverage is preferably set equal to or greater than approximately 65% to increase the carry, and can be approximately 100% if the widths of the land parts are set extremely small.

Moreover, border points are set on the border line of each noncircular dimple. The border points may be determined by calculating the midpoint position of each of the line segments and curved segments. Then, the coordinates of each border point are stored.

3-2-2. Setting of Reference Points

Then, reference points are set. For each reference point, the coordinates will be stored. For the determination of the coordinates, the reference point is specified by the depth from the surface of the virtual sphere or the distance form the center of the virtual sphere ($r_A$ in FIG. 9), and the coordinate values may be calculated on the basis of the depth or the distance. The direction of the reference point may be obtained in various ways and is set to be, for example, the direction of the barycenter of the shape having the border lines including the reference point, the direction of the barycenter obtained on the basis of the border points on the line segments, or the direction of the barycenter of the center positions of three circular dimples surrounding the noncircular dimple. The reference point may be expressed by a polar angle θ and an azimuth angle ϕ as the center of each circular dimple. Data on the reference point thus obtained is stored in any memory unit in association with the noncircular dimple. For example, when arrangement of each reference point is determined by the polar angle θ and the azimuth angle ϕ, each reference point has the polar angle θ and the azimuth angle ϕ, and the polar angle θ and the azimuth angle ϕ are thus stored in association with the depth or the distance. Here, an offset may be set in consideration of aerodynamic effects so that the reference point would be near the border line of the noncircular dimple.

3-2-3. Setting of Reference Planes

Then, a reference plane is determined. Generally, a plane is specified by a point which the plane passes and its normal vector. Here, the reference plane is limited to a plane including the reference point, and hence is determined only by determining a normal vector. The most typical way to determine the normal vector is to use the direction vector of the reference point from the center of the virtual sphere itself, or any data defining a direction vector from the reference point, for example, the above-described polar angle θ and azimuth angle ϕ of the reference point. When the direction vector of the reference point from the center of the virtual sphere itself is used as the normal vector of the reference plane, the reference plane is perpendicular to an axis connecting the center of the virtual sphere and the reference point. As information on the reference plane, at least the normal vector or data which can bring the normal vector may be stored. If the bottom surface is desired to be inclined at the reference point relative to the surface of the virtual surface, the reference plane can be set so as to be inclined.

3-2-4. Setting of Curved Reference Lines

Then, curved reference lines are obtained. A curved reference line is a curved line which passes the reference point and a border point, and which is tangential to the reference plane at the reference point. Accordingly, to determine a curved reference line, first, a direction vector at the reference point is calculated. For this calculation, a Gram-Schmidt orthogonalization process is applied to the normal vector of the reference plane and the vector from the reference point to the border point, to obtain the direction vector at the reference point and thereby store the direction vector. Next, by using the direction vector at the reference point, the curved reference line is obtained. Examples of a curved line which can be used for the determination of the curved reference line are: a quadratic curve such as a parabola, an elliptical curve or a hyperbola; a cubic or higher-degree polynomial curve; a Béezier curve, especially a quadratic or cubic Béezier curve; and a spline curve. For example, in the case of using a Béezier curve, a first straight line passing the reference point is obtained by using the stored direction vector as its own direction vector, and a second straight line passing the border point and defining the inclination of the bottom surface of the noncircular dimple at the border part is obtained on a plane including the reference point and the border point and being perpendicular to the reference plane. Then, a Béezier curve having the intersection point of the first straight line and the second straight line as the control point is calculated, thus determining the curved reference line. It is also possible to increase the number of control points, for example, by using intersection points of a straight line with the first and second straight lines as control points. Information for defining the curved reference line thus obtained (curved reference line definition information) is stored. The above-described process can be performed for each border point.

3-2-5. Setting of Facets

Then, facets are obtained. The border line of each facet can be obtained on the basis of the curved reference line definition information and the border segment definition information. In the above-described second embodiment, facets are obtained by using the boundary condition that imposes two adjacent facets to be connected smoothly with each other, in addition to the border lines of the facets. As described above, under this boundary condition, each two adjacent facets have the same tangential plane on the curved reference lines. Here, ideally, the adjacent two facets should have the same tangential plane at every point of the curved reference line. However, practically, the curved surface of the bottom surface can be formed sufficiently smooth as long as the tangential planes are commonly shared at a series of a finite number of discrete points which are appropriately distributed on the curved reference line. Accordingly, assume that the length of the curved reference line is 100, for example, where the relative position of the reference point side is 0 and the relative position of the border point side is 100. In this case, the boundary condition is set so that the tangential planes are commonly shared at the positions 20, 40, 60 and 80. Although ranges in which the tangential planes are commonly shared can be determined by various factors, the tangential planes may not necessarily be commonly shared at any point of all the curved reference line, due to other design factors. In such a case, as long as the condition is set so that the tangential planes are commonly shared at points of, for example, approximately 80% or more of the total length of the overall curved reference lines of the golf ball, 80% or more of the facets can be connected smoothly.

Such a boundary condition is set depending on a curved surface generation technique used for generating facets on the computer. For example, in the case in which facets are each generated by using a Béezier curved surface, a control point is set at each point of the series of discrete points so that each control point would be aligned with a different control point for the first facet on one side of the curved reference line (referred to as a first control point) and a different control point for the second facet on the other side of the curved reference line (referred to as a second control point) in the order of the first control point, the control point on the curved reference line and the second control point. Thereby, the first and the second facets have the same tangential plane at each point of the series of points on the curved reference line. Here, the "boundary condition" means that each of the point of the series of point on the curved reference line (curved reference line control point), the first control point and the second control point are "restricted so as to align on a straight line," in other words, that the computer operates so that the second control point for the second facet is automatically determined when the series of points on the curved reference line are defined and the first control point for the first facet is defined. Setting information for causing the computer to thus operate is stored as the boundary condition.

As described above, a facet can be determined by causing the computer to operate so that the facet would be smoothly connected to adjacent facets, in other words, each two adjacent facets have the same tangential plane at, at least, some points on the curved reference line serving as the boundary of the adjacent facets. When facets satisfying the boundary condition are generated on the overall region within the border line of the noncircular dimple, the smooth bottom surface as that obtained in the second embodiment of the present invention can be generated.

In the following, examples in which golf balls with shapes according to the respective embodiments were actually manufactured and tested in terms of their performances will be described.

Example 1

Example 1, which is a golf ball according to the first embodiment as shown in Table 1, and Comparative Example 1, which is a golf ball according to the design technique of the comparative embodiment, was manufactured. Specifically, the golf balls were each manufactured so as to have 272 dimples in total, i.e., 92 circular dimples and 180 noncircular dimples filling the gaps between the circular dimples. The dimple coverage on the surface in such a configuration with dimples was 88%. Example 1 and Comparative Example 1 have the same characteristics of the golf balls except the noncircular dimples, i.e., the same internal configuration, the same material and the same design of the circular dimples. Circular dimples used for Example 1 and Comparative Example 1 are so-called "double dimples".

TABLE 1

| | Example 1 | Comparative Example 1 |
|---|---|---|
| Total number of Dimples | 272 | |
| Of those, number of circular dimples | 92 | |
| Of those, number of noncircular dimples | 180 | |
| Surface coverage (%) | 88 | |

FIG. 20 shows an external view of Example 1. In Example 1, the schematic view of the curved reference lines and the border segments in the course of design is the same as that in FIG. 13. The external view of Comparative Example 1 is shown in FIG. 1, and the schematic view of curved reference lines and border segments in the course of design is the same as that in FIG. 5. As can be understood by comparing FIG. 5 and FIG. 13, the number of curved reference lines used in Example 1 is smaller than that used in Comparative Example 1. Nevertheless, as can be understood by comparing FIG. 1 and FIG. 20, the bottom surface of each noncircular dimple in Example 1 is smoother than that in Comparative Example 1, and ridge-like or valley-like lines are less likely to be observed at the external appearance of the ball of Example 1.

The flight performances measured through tests by hitting the golf balls of Example 1 and Comparative Example 1 are shown in Table 2. Table 2 shows results of the tests in which the golf balls were hit with a driver at a head speed of 45 m/s. As shown in Table 2, compared to Comparative Example 1, carry is improved by approximately 1.1%, from 216.2 m to 218.5 m, and the total including carry and run is improved by approximately 1.5%, from 222.8 m to 225.8 m. This is because the air resistance of the ball itself is reduced in Example 1 compared to Comparative Example 1, which increases the carry of Example 1, and the speed of the ball at the time of landing is fast, which increases the run distance.

TABLE 2

| | Example 1 | Comparative Example 1 |
|---|---|---|
| Carry (m) | 218.5 | 216.2 |
| Total (m) | 225.8 | 222.5 |
| Spin (rpm) | 2720 | 2735 |

Example 2

Example 2, which is a golf ball according to the second embodiment as shown in Table 3, and Comparative Example 2, which is a golf ball according to the design technique of the comparative embodiment, was manufactured. In Example 2, the golf balls were each manufactured so as to have a configuration with 110 circular dimples and 216 noncircular dimples filling the gaps between the circular dimples. The dimple coverage on the surface in such a configuration with dimples was 90%. As in the case of Example 1, Example 2 and Comparative Example 2 have the same characteristics of the golf balls except the noncircular dimples. Circular dimples used for Example 2 and Comparative Example 2 are also so-called double dimples.

TABLE 3

| | Example 2 | Comparative Example 2 |
|---|---|---|
| Total number of Dimples | 326 | |
| Of those, number of circular dimples | 110 | |
| Of those, number of noncircular dimples | 216 | |
| Surface coverage (%) | 90 | |

Figure 21:
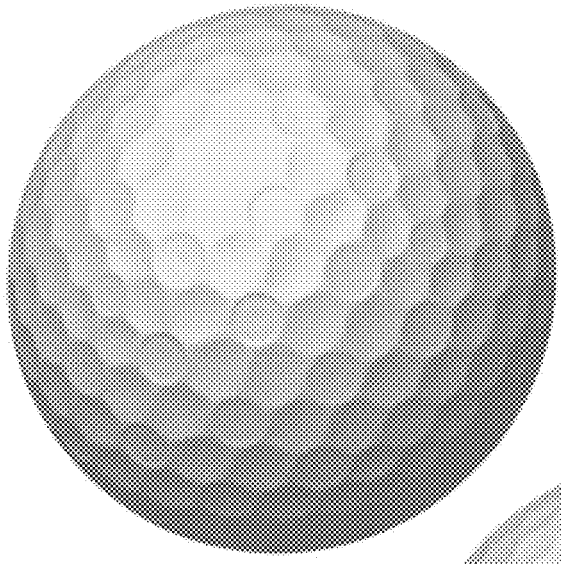
FIG. 21 is an external view of the example of the golf ball manufactured on the basis of the design according to the example of the present invention.
Figure 22:
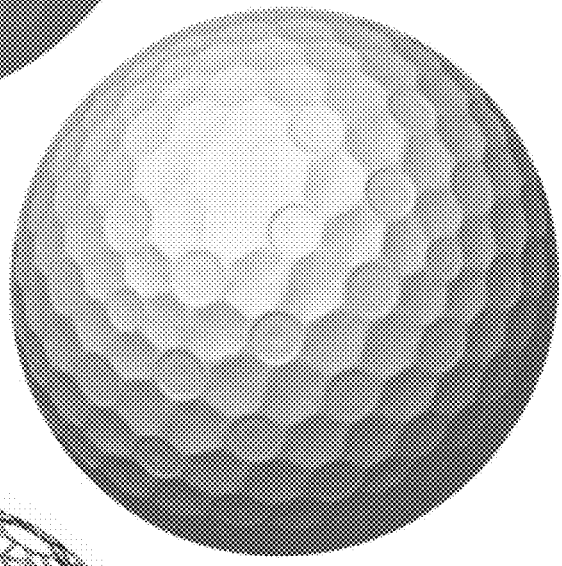
FIG. 22 is an external view of a comparative example of a golf ball manufactured on the basis of a design according to a comparative embodiment.
Figure 23:
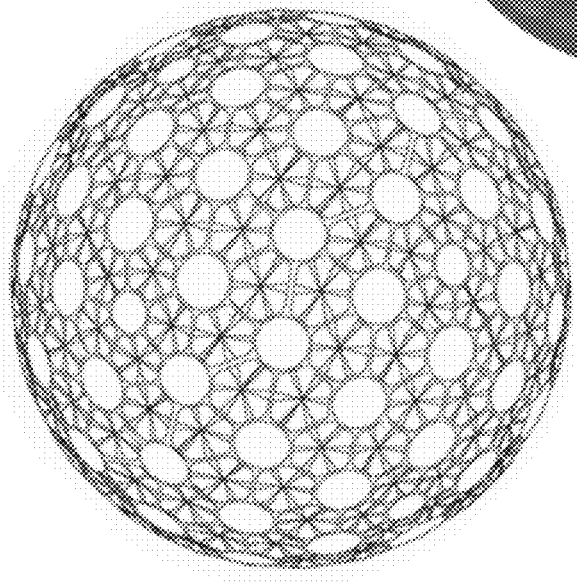
FIG. 23 is a schematic view showing a comparative example of the golf ball being designed and represented by design border segments and curved reference lines according to the comparative embodiment.

FIG. 21 shows an external view of Example 2. In Example 2, the schematic view of the curved reference lines and the border segments in the course of design is the same as that in FIG. 17. The external view of Comparative Example 2 is shown in FIG. 22, and the schematic view of the curved reference lines and the border segments in the course of design is shown in FIG. 23. As can be understood by comparing FIG. 23 and FIG. 17, the number of curved reference lines used in Example 2 is smaller than that used in Comparative Example 2. Nevertheless, as can be understood by comparing FIG. 22 and FIG. 21, the bottom surface of each noncircular dimple in Example 2 is smoother than that in Comparative Example 2, even around the border portion of the noncircular dimple. Hence, ridge-like or valley-like line pattern is not observed at the external appearance of the ball of Example 2.

The flight performances measured through tests by hitting the golf balls of Example 2 and Comparative Example 2 are shown in Table 4. Table 4 shows results of the tests performed under the same condition as the measurements for Example 1 and Comparative Example 1. As shown in Table 4, compared to Comparative Example 2, carry is improved by approximately 1.8%, from 215.4 m to 219.3 m, and the total including carry and run is improved by approximately 2.0%, from 221.7 m to 226.1 m. The inventors of the present invention think that the reason the carry is improved in Example 2 more than in Example 1 is that no ridge-like or valley-like line occurred even around the border line, as well as around the reference point, of the bottom surface of each noncircular dimple designed according to the second embodiment.

TABLE 4

| | Example 2 | Comparative Example 2 |
|---|---|---|
| Carry (m) | 219.3 | 215.4 |
| Total (m) | 226.1 | 221.7 |
| Spin (rpm) | 2725 | 2722 |

INDUSTRIAL APPLICABILITY

The present invention makes it possible to design a golf ball with an increased carry and improved appearance. This enables optimization of the surface shape of a golf ball, and thus contributes to an improvement in golf game gear.

| | |
|---|---|
| R | radius of virtual sphere |
| $D_C$ | circular dimple |
| $D_{NC}$ | noncircular dimple |

-continued

| | |
|---|---|
| A | reference point |
| $r_A$ | distance of reference point A from center of virtual sphere |
| RC | curved reference line |
| RP | reference plane |
| BS | bottom surface |
| LS | line segment |
| CS | curved segment |

What is claimed is:

1. A method for designing a golf ball including a plurality of circular dimples and a plurality of noncircular dimples in a surface, the method comprising the steps of:

arranging the circular dimples;

arranging the noncircular dimples between the circular dimples;

determining, on a virtual sphere having a diameter corresponding to an external diameter of the golf ball, a shape of a border line of each of the noncircular dimples on the surface, as a boundary line formed by connecting a plurality of border segments each being any one of a line segment and a smoothly curved segment;

determining, for the noncircular dimples, a reference point and a reference plane having the reference point, inside the virtual sphere;

setting at least five border points respectively at positions on the boundary line excluding connecting points of the border segments;

forming at least five curved reference lines, each tangential to the reference plane at the reference point, and each passing the reference point and a corresponding one of the at least five border points; and generating at least five facets each surrounded by corresponding ones of the curved reference lines and the border segments, thereby determining a shape of a bottom surface of the noncircular dimple with a shape of connecting the facets to each other, wherein, at any point on the reference line connecting between the facets adjacent to each other, the facet and the adjacent facet have the same tangential plane.

2. The method for designing a golf ball according to claim 1, wherein the step of determining the reference plane includes the step of storing a normal vector of the reference plane, and the step of forming the curved reference lines includes the steps of:

calculating and storing a projection vector for each of the border points on the basis of coordinates of the reference point, coordinates of the border point, and the normal vector, the projection vector obtained when a vector from the reference point to the border point is projected onto the reference plane; and reading the projection vector for each of the border points, and then determining, as a curved reference line for the border point, a curved line following the projection vector as a direction vector at the reference point and passing the border point.

3. The method for designing a golf ball according to claim 1, wherein the step of generating the facets includes the step of setting and storing a boundary condition under which each pair of the adjacent facets with a corresponding one of the curved reference lines interposed as a boundary have a common tangential plane at each of at least some points of the curved reference line, and the facets are generated by using the boundary condition.

* * * * *